US008451300B2

(12) United States Patent
Hsu et al.

(10) Patent No.: US 8,451,300 B2
(45) Date of Patent: May 28, 2013

(54) SYSTEM AND METHOD FOR MODULATING BACKLIGHT

(75) Inventors: Ching-Fu Hsu, Tai Chung County (TW); Chih-Chang Lai, Tai Chung County (TW)

(73) Assignee: Wintek Corporation, Taichung (TW)

( * ) Notice: Subject to any disclaimer, the term of this patent is extended or adjusted under 35 U.S.C. 154(b) by 152 days.

(21) Appl. No.: 12/979,166

(22) Filed: Dec. 27, 2010

(65) Prior Publication Data

US 2011/0157255 A1 Jun. 30, 2011

(30) Foreign Application Priority Data

Dec. 30, 2009 (TW) ..... 98145713 A

(51) Int. Cl.
*G09G 5/10* (2006.01)

(52) U.S. Cl.
USPC ..... 345/690; 345/102

(58) Field of Classification Search
USPC ..... 345/55, 87–102, 204, 690; 382/172; 362/97.2, 611–613
See application file for complete search history.

(56) References Cited

U.S. PATENT DOCUMENTS 5,598,565 A 1/1997 Reinhardt
7,053,881 B2 5/2006 Itoh
7,924,254 B2 * 4/2011 Hsu et al. ..... 345/89
8,063,922 B2 * 11/2011 Masuda et al. ..... 345/691
2008/0100645 A1 * 5/2008 Nitta ..... 345/690
2008/0297467 A1 * 12/2008 Hsu et al. ..... 345/102
2009/0284461 A1 * 11/2009 Hsu et al. ..... 345/102
2010/0165002 A1 * 7/2010 Ahn ..... 345/690
2010/0194271 A1 * 8/2010 Tomiyoshi ..... 315/32
2010/0321414 A1 * 12/2010 Muroi et al. ..... 345/690

FOREIGN PATENT DOCUMENTS

JP 06-102484 A 4/1994
JP 08-201812 A 8/1996

* cited by examiner

*Primary Examiner* — Dmitriy Bolotin
(74) *Attorney, Agent, or Firm* — Muncy, Geissler, Olds & Lowe, PLLC

(57) ABSTRACT

A backlight modulation system includes a light source module, an image mapping unit, a histogram analysis unit, a backlight dimming unit, and an image reconstruction unit. An active display area of a panel is divided into multiple illumination areas. The image mapping unit performs an RGB-to-YUV transformation to acquire an original brightness factor for each pixel. The histogram analysis unit sums up the amount of pixels reaching a preset ratio in each illumination area to acquire reference brightness for each illumination area. The backlight dimming unit calculates out a dimming ratio and a reset brightness model according to the reference brightness. The image reconstruction unit resets original brightness factor of each pixel into an output brightness factor according to the reset brightness model, and outputs an image for an illumination area according to the output brightness factor and input image data.

16 Claims, 10 Drawing Sheets

SYSTEM AND METHOD FOR MODULATING BACKLIGHT

BACKGROUND OF THE INVENTION (a) Field of the Invention

The invention relates to a system and a method for modulating backlight for a display device.

(b) Description of the Related Art

In order to reduce the power consumption of an electronic device having a liquid crystal display (LCD) panel, a typical method is to adjust the brightness of a backlight module. However, a conventional power-saving design of manually adjusting backlight usually affects the display quality. Besides, a viewer may feel uncomfortable when the backlight is adjusted to result in too bright or too dark display.

Referring to FIG. 9, Japan patent publication no. 08-201812 discloses an LCD display device 100 where backlight is dynamically adjusted to improve the conventional power-saving design. The LCD display device 100 includes a display control unit 102, an LCD display screen 104, a backlight module 106, an average brightness detecting unit 108 and a backlight control unit 110. When the average brightness detecting unit 108 detects the average brightness level of an image being at a high level, the backlight control unit 110 is used to reduce the brightness of the backlight module 106. Such design may avoid a too bright or too dark display of the LCD display screen 104 and enhances the contrast between a dark screen and a bright screen. However, when the average brightness level is at a low level, some light may leak from the backlight module 106 as a black frame is displayed to cause loss of true black and hence deteriorate the display quality.

FIG. 10 shows an improved design of backlight brightness adjustment, where backlight is dynamically adjusted according to frame signals. As shown in FIG. 10, in a backlight processing system 200, frame signals are fed into and then processed by a display control unit 202, an average brightness detecting unit 204 and a peak brightness detecting unit 206. The display control unit 202 converts the format of frame signals to enable the frame signals to be displayed on the LCD display screen 208. The average brightness detecting unit 204 calculates average brightness of the frame signals and then outputs an average brightness signal AVE serving as a backlight adjustment parameter to the backlight control unit 212. The peak brightness detecting unit 206 performs peak calculation on pixel data of different frame signals to acquire a peak signal PEK that is transmitted to the backlight control unit 212. The backlight control unit 212 adjusts the brightness of the backlight module 214 according to the average brightness signal AVE and the peak signal PEK. Though such design may dynamically adjust the brightness of a displayed frame to achieve power-saving, the displayed frame seen by human eyes is relatively dark and fails to convey the original visual effect.

BRIEF SUMMARY OF THE INVENTION

The invention provides a system and a method for modulating backlight capable of effectively increasing image contrast and maintaining chroma originality.

According to the design of one embodiment of the invention, a system for modulating backlight comprises a light source module, an image mapping unit, a histogram analysis unit, a backlight dimming unit, and an image reconstruction unit. The light source module provides backlight for a display panel and forms a plurality of illumination areas corresponding to a display area of the display panel. The illumination areas are adjacent to each other and substantially cover the display area. The image mapping unit transforms an image to be displayed by the display panel from a RGB color model to a color model independent of an image processing device to acquire an original brightness factor for each pixel. The histogram analysis unit sums up the amount of total pixels of each illumination area and calculates the amount of accumulated pixels in each illumination area reaching a preset ratio to acquire reference brightness for each illumination area. The backlight dimming unit calculates a backlight dimming ratio and a mapping calibration curve of each illumination area according to the reference brightness of each illumination area where the backlight dimming ratio BD(n) of the $n^{th}$ illumination area satisfies the following criterion:

$$BD(n)=Var+[ABL_(n)/(ABL_{MAX}/(1-Var))],$$

where Var is a variable larger than 0 and smaller than 1, ABL_(n) is the reference brightness of the $n^{th}$ illumination area and $ABL_{MAX}$ is the maximum reference brightness. When the light source module comprises $N_a$ light sources to divide the display area into $(N_a+1)$ illumination areas, if each illumination area is distributed with $N_p$ scan lines, the slope of the mapping calibration curve of all the $N_p$ scan lines in the first illumination area is the inverse of the backlight dimming ratio of the first light source, the slope of the mapping calibration curve of all the $N_p$ scan lines in the $(N_a+1)^{th}$ illumination area is the inverse of the backlight dimming ratio of the $N_a^{th}$ light source and the slope S(m,n) of the mapping calibration curve of the $m^{th}$ scan lines in the $n^{th}$ illumination area of the $2^{nd}$ to $(N_a)^{th}$ illumination areas satisfies the following criterion:

$$zS(m,n)=\frac{1}{BD_{(n-1)}+(BD_{(n)}-BD_{(n-1)})\times\frac{m}{Np}},$$

where $BD_{(n)}$ represents the backlight dimming ratio of the $n^{th}$ illumination area, $BD_{(n-1)}$ represents the backlight dimming ratio of the $(n-1)^{th}$ illumination area, $2 \leqq n \leqq N_a$, $1 \leqq m \leqq N_p$, and m and n are positive integers. The image reconstruction unit resets the original brightness factor of each pixel in an illumination area into an output brightness factor according to the mapping calibration curve of the illumination area and outputs an image for the corresponding illumination area according to the output brightness factor and input image data.

According to the design of another embodiment of the invention, a method for modulating backlight comprises the following steps: forming a plurality of illumination areas corresponding to a display area of a display panel, wherein the illumination areas are adjacent to each other and substantially cover the display area; transforming a RGB color model of an image to be displayed on the display panel into a color model independent of an image processing device to acquire an original brightness factor for each pixel; summing up the amount of total pixels of each illumination area and calculating the amount of accumulated pixels in each illumination area reaching a preset ratio to acquire reference brightness for each illumination area; calculating out a backlight dimming ratio and a reset brightness model for each illumination area according to the reference brightness of each illumination area; resetting the original brightness factor of each pixel into an output brightness factor according to the reset brightness model; and outputting an image for the corresponding illumination area according to the output brightness factor and input image data.

According to the above design of each embodiment, since the display area corresponding to the position distribution of light sources are divided into a plurality of independent illumination areas and the backlight dimming ratio and the mapping calibration curve of each illumination area can be acquired based on the statistical result of brightness factors, the backlight can be locally and accurately adjusted and the image brightness distortion after backlight adjustment can be avoided.

Other objects and advantages of the invention can be better understood from the technical characteristics disclosed by the invention. In order to clarify the above mentioned and other objects and advantages of the invention, examples accompanying with figures are provided and described in details in the following.

DETAILED DESCRIPTION OF THE INVENTION

The above and other technical content, characteristics, and functions of the invention will be described in details with reference to the drawings. For clarity, the wording related to direction, such as up, down, left, right, front, back, etc., used in examples is referred to the direction in drawings. Therefore, the wording related to direction is not used to limit the scope of the invention.

Figure 1:
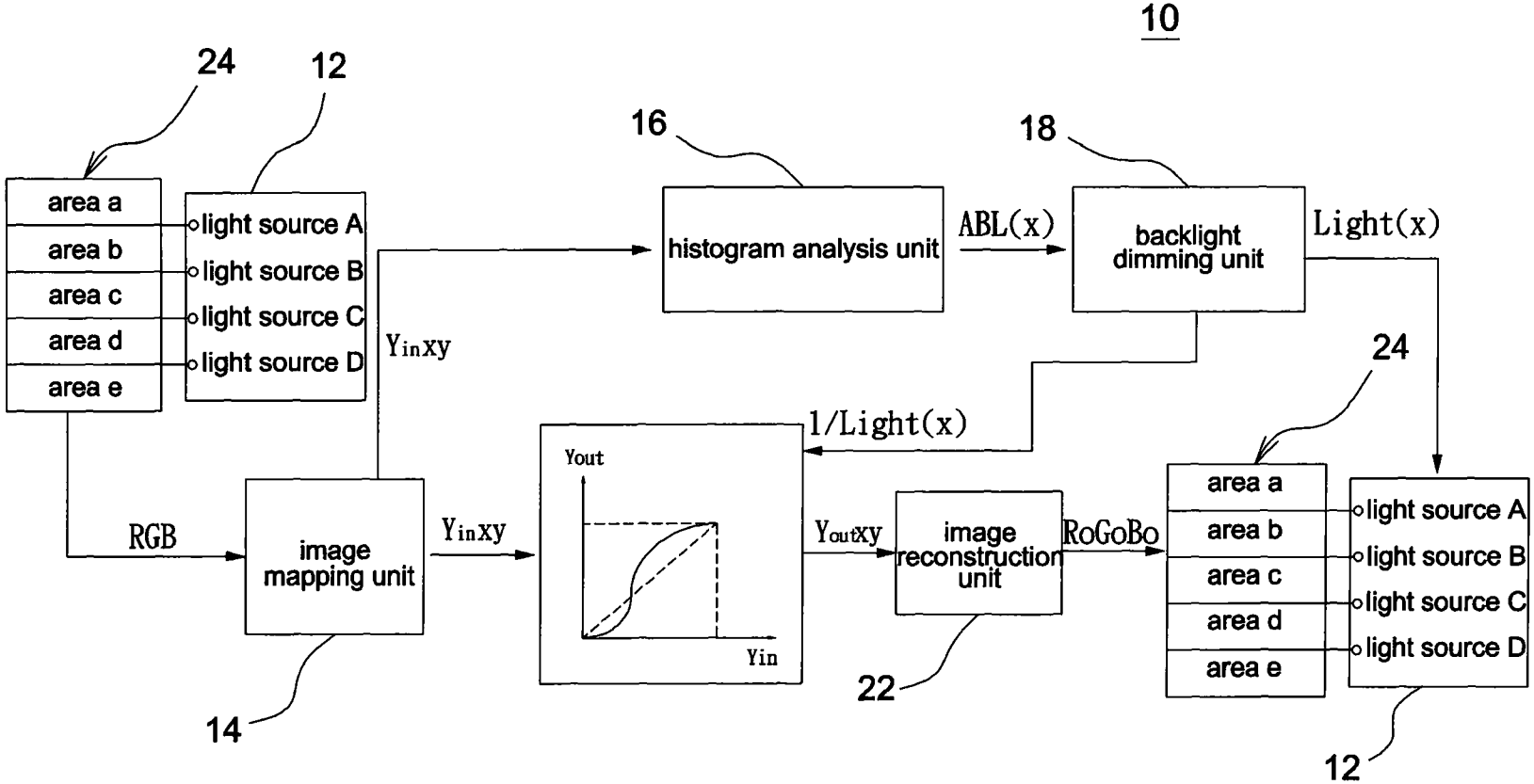
FIG. 1 shows a schematic diagram illustrating the system for modulating backlight according to one embodiment of the invention.
Figure 2:
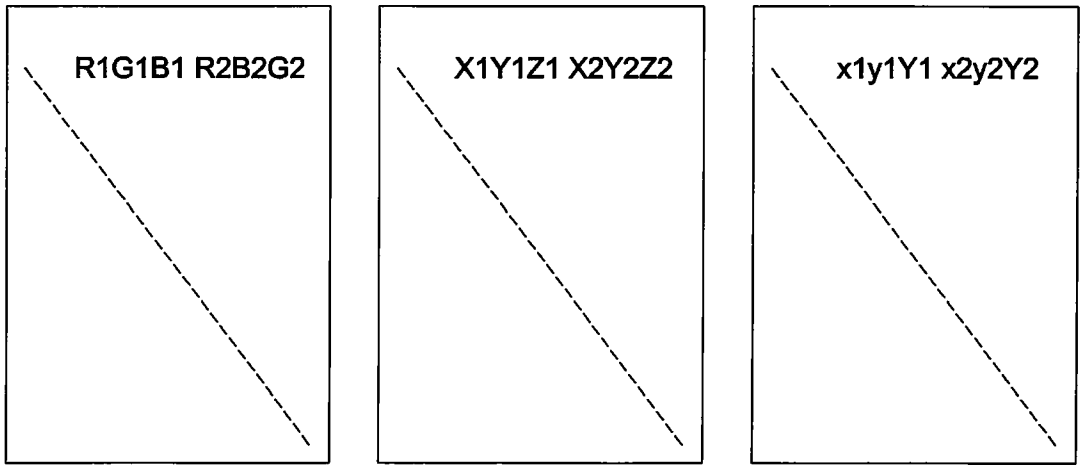
FIG. 2 shows a schematic diagram illustrating the method of image transformation according to one embodiment of the invention.
Figure 3:
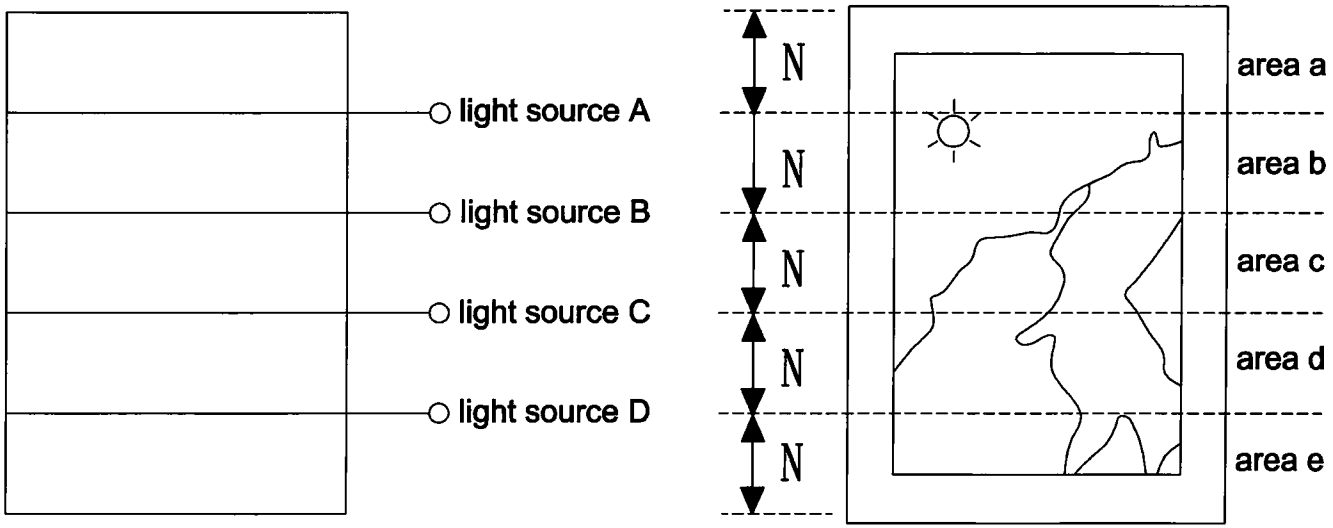
FIG. 3 shows a schematic diagram illustrating the illumination module and the illumination areas according to one embodiment of the invention.

FIG. 1 shows a schematic diagram illustrating a backlight modulation system for modulating backlight according to one embodiment of the invention. As shown in FIG. 1, the backlight modulation system 10 includes a light source module 12, an image mapping unit 14, a histogram analysis unit 16, a backlight dimming unit 18, and an image reconstruction unit 22. The light source module 12 provides backlight for a display panel (not shown) and forms a plurality of illumination areas corresponding to a display area 24 of the display panel. In this embodiment, the backlight modulation system 10 firstly uses the image mapping unit 14 to perform data transformation. For example, as shown in FIG. 2, the RGB-to-tristimulus XYZ matrix transformation on the pixel data (Ri, Gi, Bi) is performed to generate a value (Xi, Yi, Zi), and then the XYZ-to-xyY color coordinate matrix transformation on the tristimulus value (Xi, Yi, Zi) is performed to generate a chromatic coordinate (x1,y1) and a brightness factor (Y1) of a x1y1Y1 color mode. The chromatic factors and the brightness factors of the entire image are obtained by repeating such transformation and then stored. In this embodiment, as shown in FIG. 3, four linear light sources formed by light emitting diode (LED) light bars are parallel positioned below the display panel and divide the display area into five illumination areas a to e, where the illumination areas a-e are adjacent to each other and substantially cover the display area 24. The histogram analysis unit 16 uses the Y brightness factors transformed by the image mapping unit 14 to perform image information analysis and then stores the distribution of the brightness factors of each illumination area a-e.

Figure 4:
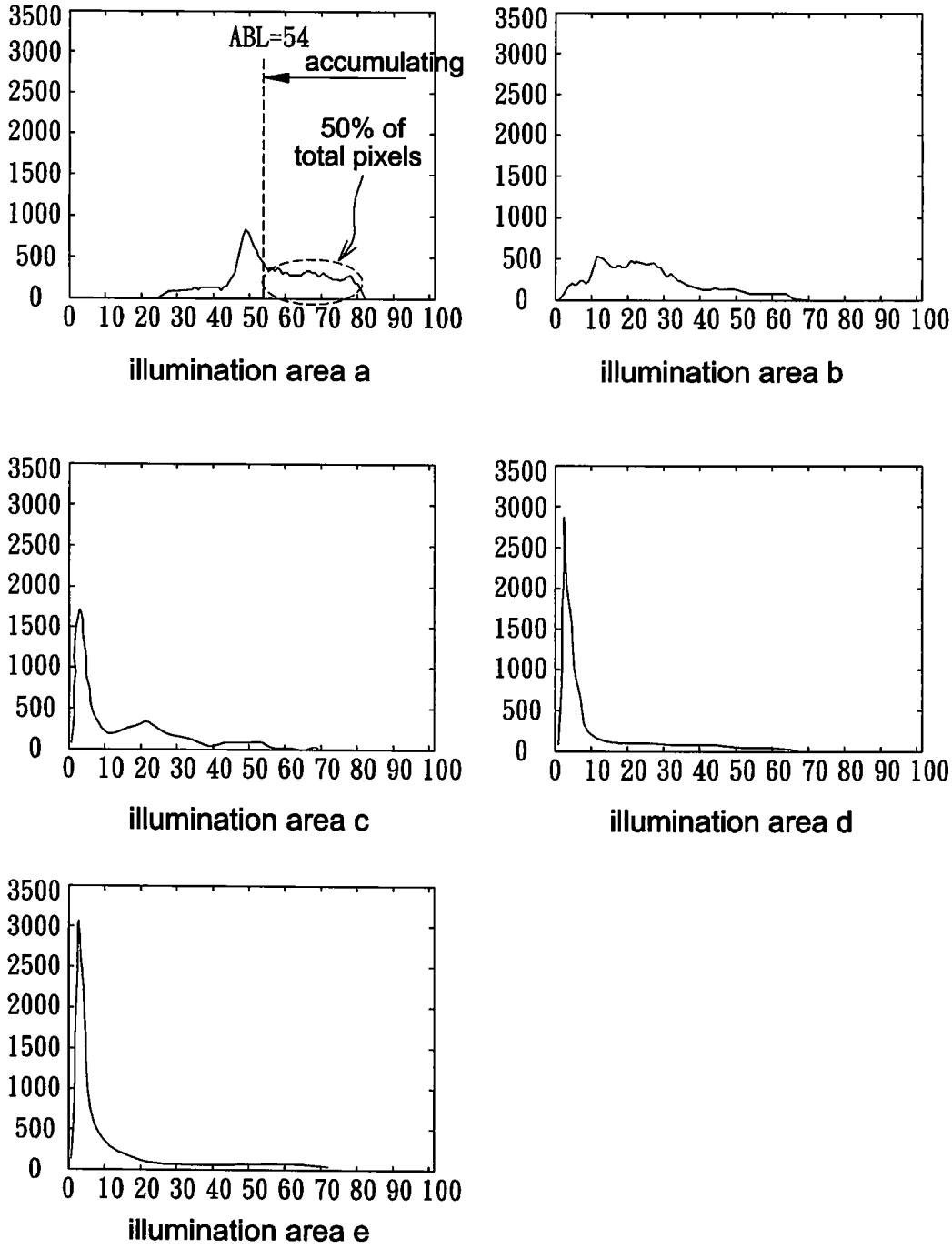
FIG. 4 shows a schematic diagram illustrating the distribution of the pixel brightness factor in each illumination area according to an embodiment of the invention.

FIG. 4 shows a schematic diagram illustrating the distribution of the pixel brightness factor in each illumination area a-e according to an embodiment of the invention. In one embodiment, the amount of pixels in each illumination area is accumulated from the highest brightness factor toward a lower brightness factor until the amount of accumulated pixels is larger than a preset proportion (for example 50%) of total pixels in one illumination area, and the last brightness factor counted at the stop of accumulation is defined as the reference brightness ABL_(x) of the illumination area. In other words, the reference brightness ABL_(x) is the brightness factor fetched when the amount of accumulated pixels is equal to the product of the amount of total pixels and a preset ratio or when the amount of accumulated pixels is larger than a minimum integer of the product of the amount of total pixels and the preset ratio. For example, on the upper left-hand side of FIG. 4, when the preset ratio is set as 50% of total pixels, the reference brightness ABL_(x) of the illumination area a is ABL_(x)=54. The following table shows the reference brightness ABL_(x) of each illumination area a-e. The reference brightness ABL_(x) is used as a reference for adjusting the brightness of the backlight for each illumination area.

TABLE 1

| Illumination area | ABL_(x) | BD |
|---|---|---|
| a | 54 | 0.77 |
| b | 24 | 0.62 |
| c | 13 | 0.565 |
| d | 6 | 0.53 |
| e | 4 | 0.52 |

The following will describe the method of using the reference brightness ABL_(x) to acquire the backlight dimming ratio and then using the backlight dimming ratio to correspondingly compensate the pixel brightness of the illumination area.

In this embodiment, when the backlight is dimmed for power saving, the backlight dimming ratio BD(n) of the $n^{th}$ illumination area can be obtained from the following equation:

$$BD(n)=\mathrm{Var}+[ABL_(n)/(ABL_{MAX}/1-Var)],$$

where Var is a variable larger than 0 and smaller than 1 (determined by a backlight module manufacturer), ABL_(n) is the reference brightness of the $n^{th}$ illumination area and $ABL_{MAX}$ is the maximum reference brightness. It is assumed that Var=0.5 and the maximum reference brightness $ABL_{MAX}$=100 (since Y brightness factor is 0-100 after transformation). The backlight dimming ratio BD(n) for each of the illumination areas a-e is shown in Table 1.

Then, after the backlight brightness of each illumination area is adjusted, pixel signals have to be reset accordingly to compensate the image brightness distortion due to the dimming adjustment on a light source. Briefly, when the backlight dimming ratio BD(n)=80%, the backlight brightness is reduced by 20% and the Y brightness factor of the input image signal should be multiplied by the inverse of the backlight dimming ratio BD(n) (1/0.8=1.25) to have the final output image brightness be equal to the input image brightness. Therefore, taking FIG. 3 as an example, the light sources A, B, C and D divide the display area into five illumination areas a-e, and the backlight dimming ratios are BD_A, BD_B, BD_C and BD_D. Also, it is assumed that each illumination area occupies a distribution area of 64 scan lines and N represents an $N^{th}$ scan line of the 64 scan lines for each illumination area. Thus, when a reset transformation is one-by-one performed on each pixel array, the reset ratio factor for each of the illumination areas a-e is shown in the following table.

TABLE 2

| Illumination area | Reset ratio factor (slope of a mapping calibration curve) |
|---|---|
| a | 1/BD_A |
| b | 1/[BD_A + (BD_B − BD_A) × (1/64) × N] |
| c | 1/[BD_B + (BD_C − BD_B) × (1/64) × N] |
| d | 1/[BD_C + (BD_D − BD_C) × (1/64) × N] |
| e | 1/BD_D |

Figure 5A:
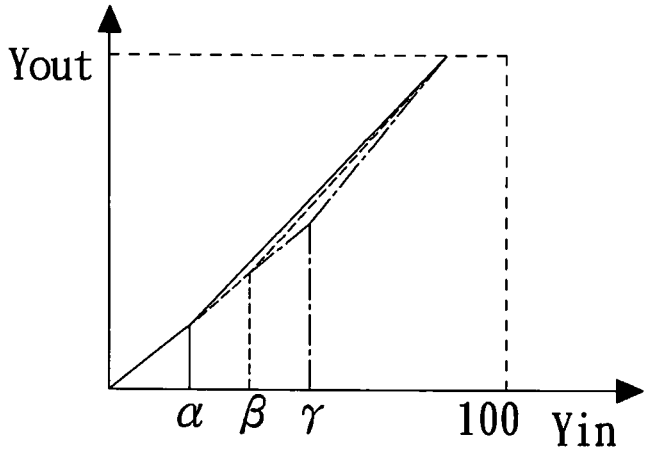
FIGS. 5A-5C show schematic diagrams illustrating the mapping calibration curves according to one embodiment of the invention.
Figure 5B:
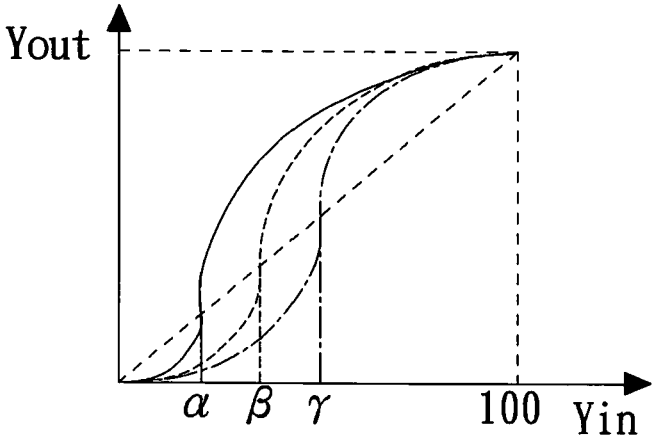
Figure 5C:
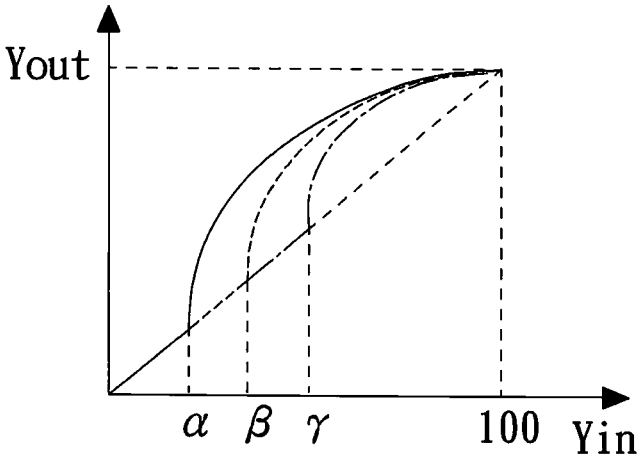

Therefore, the image of each pixel array that corresponds to an $N^{th}$ scan line corresponds to a mapping calibration curve, and the slope of the mapping calibration curve is the reset ratio factor in Table 2. For example, all the pixel arrays in the area a and area e correspond to a constant slope of a mapping calibration curve, but the slope of a mapping calibration curve of a pixel array in the area b, area c or area d varies according to the order of the pixel array. Of course, in the above, N=64 is only an example and the number of scan lines occupied by each illumination area is not limited. FIGS. 5A-5C show different mapping calibration curves from the arithmetic operation of Table 2. The original brightness factor Yin can be used to calculate the output brightness factor Yout by the interpolation or extrapolation of the mapping calibration curve. Therefore, after the backlight dimming unit 18 calculates the backlight dimming ratio and the reset brightness model of each illumination area according to the reference brightness of each illumination area, the backlight intensity of the light source module 12 is reduced according to the backlight dimming ratio and the image reconstruction unit 22 resets the original brightness factor of each pixel into an output brightness factor according to the reset brightness model (mapping calibration curve). Further, the image reconstruction unit 22 outputs an image for the corresponding illumination area according to the output brightness factor and input image data. For example, since the chromatic factor (x,y) and the brightness factor (Yin) of each pixel is separated in advance, during the pixel data transformation, only the brightness factor is transformed but the chromatic coordinate (x1,y1) is unchanged. Then, a transformed output brightness factor Yout and the original input value (chromatic coordinate (x1,y1)) are used to output XoYoZo tristimulus values through a xyY-to-XYZ transformation matrix. Finally, the XoYoZo tristimulus values are transformed to new pixel data RoGoBo through a XYZ-to-RGB transformation matrix.

The above embodiment divides the display area into five illumination areas by four light sources (light sources A, B, C and D) and calculates the slope of the mapping calibration curve for each illumination area. By analogy, when the light source module comprises $N_a$ light sources to divide the display area into $(N_a+1)$ illumination areas, if each illumination area is distributed with $N_p$ scan lines, the slope of the mapping calibration curve of all the $N_p$ scan lines in the first illumination area is the inverse of the backlight dimming ratio of the first light source (=1/BD(1)), the slope of the mapping calibration curve of all the $N_p$ scan lines in the $(N_a+1)^{th}$ illumination area is the inverse of the backlight dimming ratio of the $N_a^{th}$ light source $(=1/BD(N_a))$, and the slope S(m,n) of the mapping calibration curve of the $m^{th}$ scan lines in the $n^{th}$ illumination area of the $2^{nd}$ to $(N_a)^{th}$ illumination areas satisfies the following criterion:

$$S(m,n)=\frac{1}{BD_{(n-1)}+(BD_{(n)}-BD_{(n-1)})\times\frac{m}{Np}},$$

where $BD_{(n)}$ represents the backlight dimming ratio of the $n^{th}$ illumination area, $BD_{(n-1)}$ represents the backlight dimming ratio of the $(n-1)^{th}$ illumination area, $2\leqq n\leqq N_a$, $1\leqq m\leqq N_p$, and m and n are positive integers.

By the design of the above embodiment, since the display area corresponding to the position distribution of light sources are divided into a plurality of independent illumination areas and the backlight dimming ratio and the mapping calibration curve for each illumination area can be acquired based on the statistic result of brightness factors, the backlight can be locally and accurately adjusted and the image brightness distortion due to an adjustment on backlight can be avoided. Therefore, a display is allowed to have low power consumption and high contrast under the condition that the original chroma is still maintained. Certainly, the invention is not limited to transform an RGB color model into an xyY color model. The other color model capable of acquiring the brightness factor and independent of an image processing device such as Lab color model, Luv color model, etc., can be utilized in the invention. Herein, a color model independent of an image processing device mean that the color model may represent an identical color no matter which image processing device is used.

Figure 6:
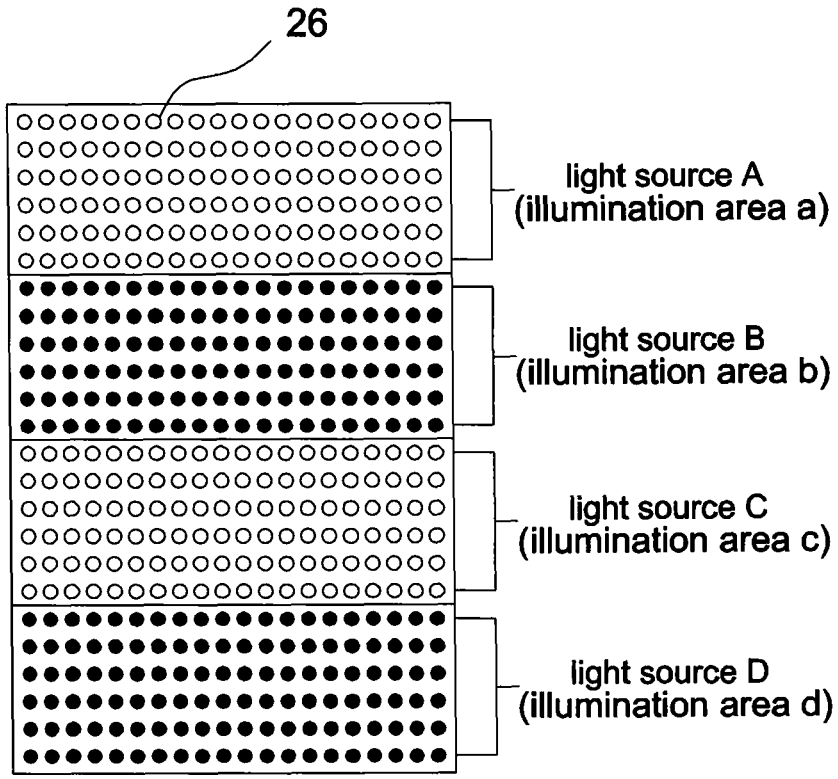
FIG. 6 shows a schematic diagram illustrating the light source module according to another embodiment of the invention.
Figure 7:
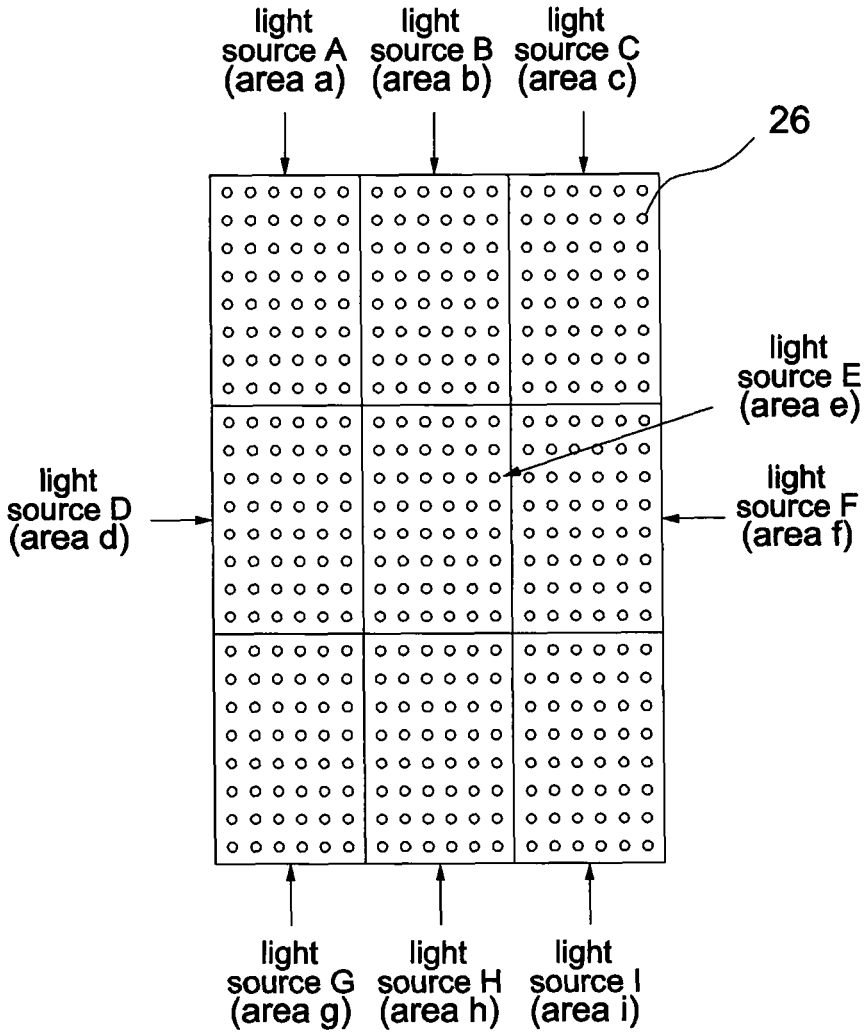
FIG. 7 shows a schematic diagram illustrating the light source module according to another embodiment of the invention.

Further, in one embodiment, a point light source can be used instead of a linear light sources for providing backlight. For example, the light source of FIG. 6 may include a plurality of LEDs 26 to form an LED array. The LED array is divided into different areas, such as four areas in FIG. 6, and the backlight dimming ratio and the mapping calibration curve for each area can be calculated separately to obtain the same effect of accurate backlight adjustment. Besides, the method of separating the illumination areas corresponding to a display area is not limited to the above example. For example, FIG. 7 shows that a display area is divided into nine illumination areas forming a 3*3 matrix and the backlight dimming ratio and the mapping calibration curve for each area can be calculated out separately.

Figure 8:
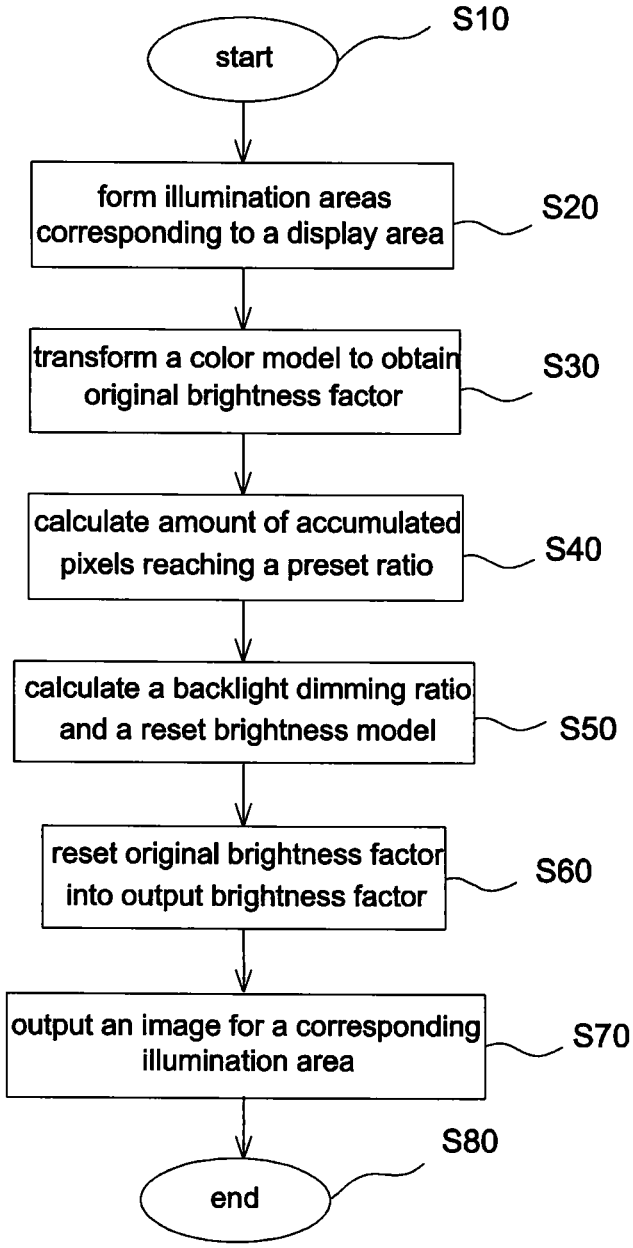
FIG. 8 shows a flow chart illustrating the method for modulating backlight according to one embodiment of the invention.
Figure 9:
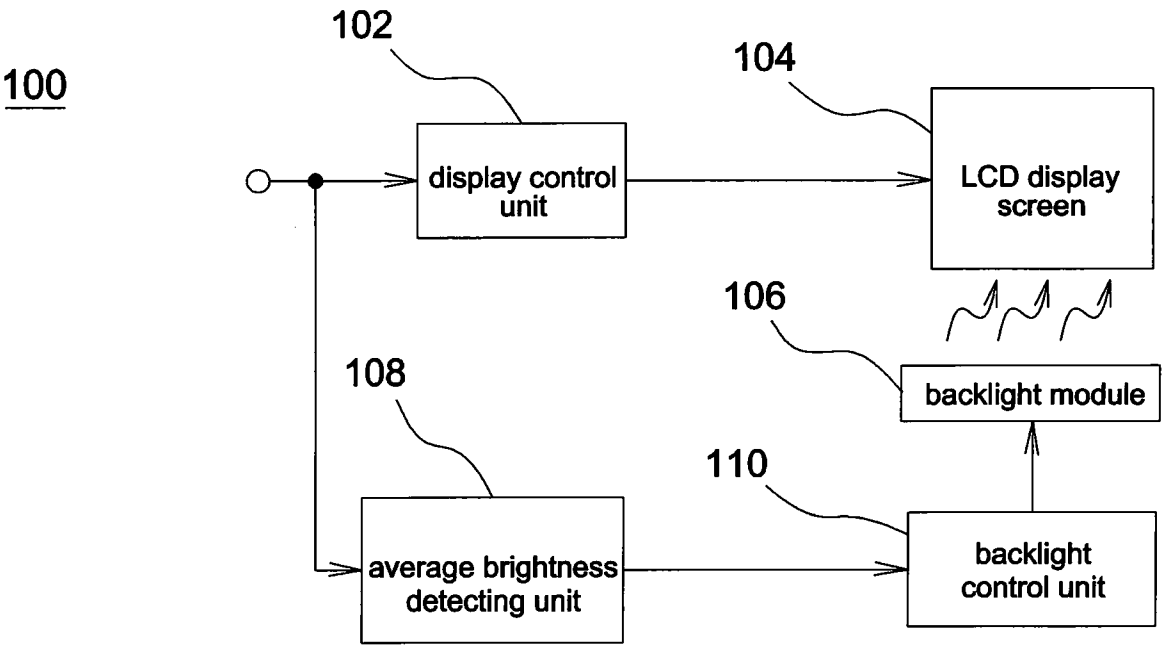
FIG. 9 (Prior Art)
FIG. 9 shows a schematic diagram illustrating a conventional backlight processing system.
Figure 10:
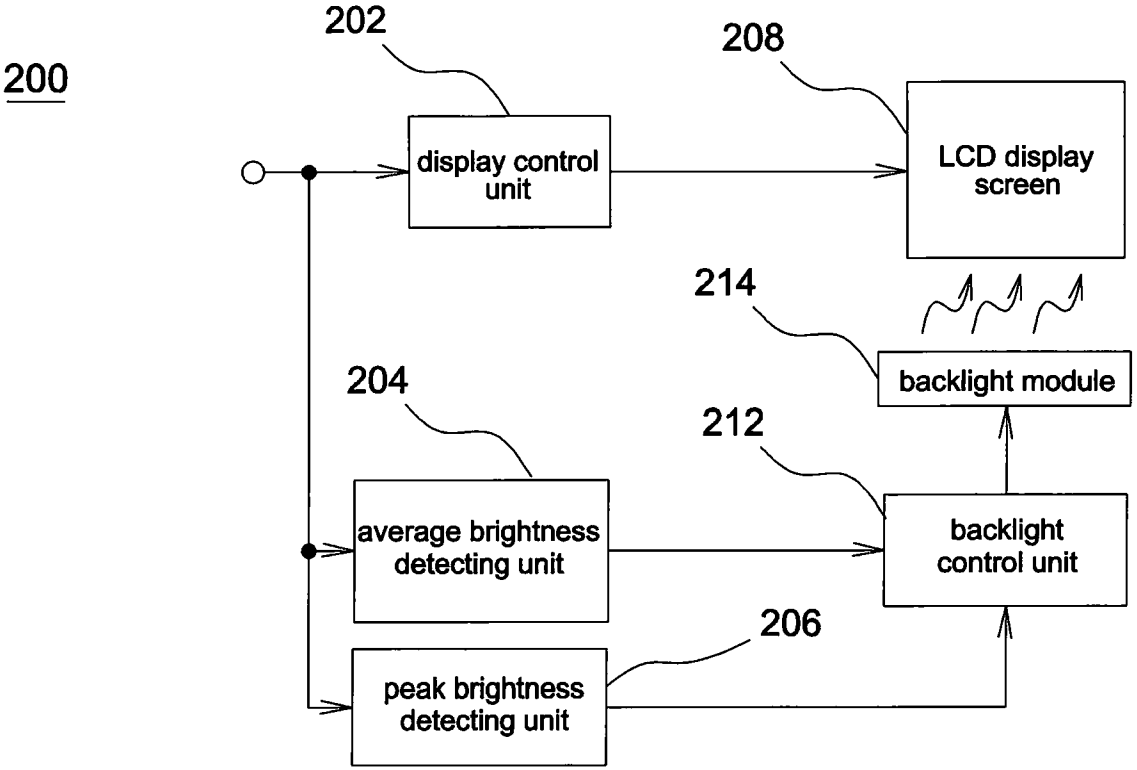
FIG. 10 (Prior art)
FIG. 10 shows a schematic diagram illustrating another conventional backlight processing system.

FIG. 8 shows a flow chart illustrating the method for modulating backlight according to one embodiment of the invention. As shown in FIG. 8, the method includes the following steps:

Step S10: start;

Step S20: forming a plurality of illumination areas corresponding to a display area of a display panel, where the illumination areas are adjacent to each other and substantially cover the display area;

Step S30: transforming a RGB color model of an image to be displayed on the display panel into another color model independent of an image processing device to acquire an original brightness factor for each pixel;

Step S40: summing up the amount of total pixels of each illumination area and calculating the amount of accumulated pixels in each illumination area reaching a preset ratio to acquire a reference brightness for each illumination area;

Step S50: calculating out a backlight dimming ratio and a reset brightness model for each illumination area according to the reference brightness of each illumination area;

Step S60: resetting the original brightness factor of each pixel into an output brightness factor according to the reset brightness model;

Step S70: outputting an image for the corresponding illumination area according to the output brightness factor and input image data; and Step S80: end.

Although the present invention has been fully described by the above embodiments, the embodiments should not constitute the limitation of the scope of the invention. Various modifications or changes can be made by those who are skilled in the art without deviating from the spirit of the invention. Any embodiment or claim of the present invention does not need to reach all the disclosed objects, advantages, and uniqueness of the invention. Besides, the abstract and the title are only used for assisting the search of the patent documentation and should not be construed as any limitation on the implementation range of the invention.

What is claimed is:

1. A system for modulating backlight, comprising:

a light source module providing backlight for a display panel and forming a plurality of illumination areas corresponding to a display area of the display panel, wherein the illumination areas are adjacent to each other and substantially cover the display area;

an image mapping unit performing a transformation on an image displayed on the display panel to convert a RGB color model of the image to another color model independent of an image processing device to acquire an original brightness factor for each pixel of the image;

a histogram analysis unit summing up the amount of total pixels of each illumination area and calculating the amount of accumulated pixels in each illumination area reaching a preset ratio to acquire a reference brightness for each illumination area;

a backlight dimming unit calculating a backlight dimming ratio and a mapping calibration curve of each illumination area according to the reference brightness of each illumination area, wherein the backlight dimming ratio BD(n) of the $n^{th}$ illumination area satisfies the following criterion:

$$BD(n)=Var+[ABL_(n)/(ABL_{MAX}/(1-Var))],$$

where Var is a variable larger than 0 and smaller than 1, ABL_(n) is the reference brightness of the $n^{th}$ illumination area and $ABL_{MAX}$ is the maximum reference brightness; when the light source module comprises $N_a$ light sources to divide the display area into $(N_a+1)$ illumination areas, if each illumination area is distributed with $N_p$ scan lines, the slope of the mapping calibration curve of all the $N_p$ scan lines in the first illumination area is the inverse of the backlight dimming ratio of the first light source, the slope of the mapping calibration curve of all the $N_p$ scan lines in the $(N_a+1)^{th}$ illumination area is the inverse of the backlight dimming ratio of the $N_a^{th}$ light source and the slope S(m,n) of the mapping calibration curve of the $m^{th}$ scan lines in the $n^{th}$ illumination area of the $2^{nd}$ to $(N_a)^{th}$ illumination areas satisfies the following criterion:

$$S(m,n)=\frac{1}{BD_{(n-1)}+(BD_{(n)}-BD_{(n-1)})\times\frac{m}{Np}},$$

where $BD_{(n)}$ represents the backlight dimming ratio of the $n^{th}$ illumination area, $BD_{(n-1)}$ represents the backlight dimming ratio of the $(n-1)^{th}$ illumination area, $2\leqq n\leqq N_a$, $1\leqq m\leqq N_p$, and m and n are positive integers; and an image reconstruction unit resetting the original brightness factor of each pixel in an illumination area into an output brightness factor according to the mapping calibration curve of the illumination area and outputting an image for the corresponding illumination area according to the output brightness factor and input image data.

2. The system according to claim 1, wherein the light source module comprises a plurality of linear light sources and the linear light sources divide the display area into the illumination areas.

3. The system according to claim 1, wherein the light source module comprises a light emitting diode array.

4. The system according to claim 1, wherein the illumination areas are arranged into an array.

5. The system according to claim 1, wherein the color model independent of an image processing device is a xyY color model, an Lab color model, or an Luv color model.

6. The system according to claim 1, wherein the amount of accumulated pixels is calculated by accumulating the amount of pixels for each individual brightness factor from the highest brightness factor toward a lower brightness factor.

7. The system according to claim 1, wherein the reference brightness is the value of an original brightness factor fetched when the amount of accumulated pixels is equal to the product of the amount of total pixels and the preset ratio or when the amount of accumulated pixels is larger than a minimum integer of the product of the amount of total pixels and the preset ratio.

8. The system according to claim 1, wherein the maximum reference brightness $ABL_{MAX}$ is equal to 100.

9. The system according to claim 1, wherein the illumination area covers a plurality of pixel arrays and each pixel array corresponds to a mapping calibration curve.

10. The system according to claim 1, wherein the input image data comprises a chromatic factor for each pixel.

11. A method for modulating backlight, comprising:

forming a plurality of illumination areas corresponding to a display area of a display panel, wherein the illumination areas are adjacent to each other and substantially cover the display area;

transforming a RGB color model of an image to be displayed on the display panel into another color model independent of an image processing device to acquire an original brightness factor for each pixel;

summing up the amount of total pixels of each illumination area and calculating the amount of accumulated pixels in each illumination area reaching a preset ratio to acquire a reference brightness for each illumination area;

calculating out a backlight dimming ratio and a reset brightness model for each illumination area according to the reference brightness of each illumination area;

resetting the original brightness factor of each pixel into an output brightness factor according to the reset brightness model; and outputting an image for the corresponding illumination area according to the output brightness factor and input image data, wherein the backlight dimming ratio BD(n) of the $n^{th}$ illumination area satisfies the following criterion:

$$BD(n)=Var+[ABL_(n)/(ABL_{MAX}/(1-Var))],$$

where Var is a variable larger than 0 and smaller than 1, ABL_(n) is the reference brightness of the $n^{th}$ illumination area and $ABL_{MAX}$ is the maximum reference brightness; the light source module comprises $N_a$ light sources to divide the display area into $(N_a+1)$ illumination areas, if each illumination area is distributed with $N_p$ scan lines, the slope of the mapping calibration curve of all the $N_p$ scan lines in the first illumination area is the inverse of the backlight dimming ratio of the first light source, the slope of the mapping calibration curve of all the $N_p$ scan lines in the $(N_2+1)^{th}$ illumination area is the inverse of the backlight dimming ratio of the $N_a^{th}$ light source and the slope S(m,n) of the mapping calibration curve of the $m^{th}$ scan lines in the $n^{th}$ illumination area of the $2^{nd}$ to $(N_a)^{th}$ illumination areas satisfies the following criterion:

$$S(m, n) = \frac{1}{BD_{(n-1)} + (BD_{(n)} - BD_{(n-1)}) \times \frac{m}{Np}},$$

where $BD_{(n)}$ represents the backlight dimming ratio of the $n^{th}$ illumination area, $BD_{n-1)}$ represents the backlight dimming ratio of the $(n-1)^{th}$ illumination area, $2 \leqq n \leqq N_a$, $1 \leqq m \leqq N_p$, and m and n are positive integers.

12. The method according to claim 11, wherein the illumination area covers a plurality of pixel arrays and each pixel array corresponds to a mapping calibration curve.

13. The method according to claim 11, wherein the color model independent of an image processing device is a xyY color model, an Lab color model, or an Luv color model.

14. The method according to claim 11, wherein the amount of accumulated pixels is calculated by accumulating the amount of pixels for each individual brightness factor from the highest brightness factor toward a lower brightness factor.

15. The method according to claim 11, wherein the reference brightness is the value of an original brightness factor fetched when the amount of accumulated pixels is equal to the product of the amount of total pixels and the preset ratio or when the amount of accumulated pixels is larger than a minimum integer of the product of the amount of total pixels and the preset ratio.

16. The method according to claim 11, wherein the input image data comprises a chromatic factor for each pixel.

* * * * *